United States Patent [19]

Kelsey

[11] Patent Number: 4,715,149

[45] Date of Patent: Dec. 29, 1987

[54] STEADY REST FOR VALVE GRINDING APPARATUS

[76] Inventor: John R. Kelsey, 8575 Louisiana Pl., Merrillville, Ind. 46410

[21] Appl. No.: 900,298

[22] Filed: Aug. 25, 1986

[51] Int. Cl.[4] ..... B24B 19/00

[52] U.S. Cl. ..... 51/241 VS

[58] Field of Search ..... 51/241 VS, 241 B, 245

[56] References Cited

U.S. PATENT DOCUMENTS

| | | | |
|---|---|---|---|
| 126,522 | 5/1872 | Cooper | 51/241 A |
| 1,308,222 | 7/1919 | Brown | 51/241 VS |
| 1,796,208 | 3/1931 | Mahoney | 51/241 VS |
| 2,292,383 | 8/1942 | Liebmann | 51/241 VS |
| 2,541,412 | 2/1951 | Frost | 51/245 |
| 2,908,120 | 10/1959 | Jensen | 51/241 VS |
| 4,106,880 | 8/1978 | Anders | 51/241 A |
| 4,169,487 | 10/1979 | Watson | 51/241 VS |

*Primary Examiner*—Harold D. Whitehead

*Attorney, Agent, or Firm*—Guy E. Matthews

[57] ABSTRACT

Flow valve seat grinding apparatus incorporating an improved steady rest means. Includes a tubular drive shaft housing which houses and supports a rotatable and longitudinally movable drive shaft means. Drive shaft is connected through a flexible torque coupler to drive a valve seat grinding head. Grinding head is adapted to grind a valve seat located within a valve body. Includes adjustable anchor operable to laterally extend at least three anchor members into fixed anchoring contact with a sidewall of a valve body to laterally support the shaft housing in fixed position within the valve body.

15 Claims, 5 Drawing Figures

STEADY REST FOR VALVE GRINDING APPARATUS

FIELD OF THE INVENTION

This invention generally relates to apparatus for grinding flow valve seats and more particularly relates to an improved steady rest mechanism for better controlling the valve seat grinding operation for valve seats located deep within a valve cavity and wherein the valve itself may be mounted in a flow pipeline located somewhat remote from the operator of the grinding apparatus.

BACKGROUND OF THE INVENTION

A valve seat grinding apparatus is disclosed in U.S. Pat. No. 4,287,688. As disclosed, the present invention is a combination of the kind as disclosed in this patent and, accordingly, the patent is hereby incorporated by reference. The commonly owned and copending U.S. application Ser. No. 650,841, filed Sept. 17, 1984 now U.S. Pat. No. 4,610,112, has of record the presently known prior art pertaining to valve grinding apparatus, including German GM No. 8303975 (1983). Also of record in this referenced application is Ser. No. 705,869, filed Feb. 28, 1985, which has been allowed. The flexible shaft torque transfer coupler disclosed herein may be a coupler as disclosed in either of the above referenced U.S. or German patents, or a modification of the coupler disclosed in the commonly owned and copending U.S. application Ser. No. 843,292, filed Mar. 24, 1986, and entitled "Improved Valve Seat Grinding Apparatus".

OBJECTS OF THE INVENTION

A principle object of the present invention is to grind the seat of a valve while the valve remains installed in a flow line.

Another object of the present invention is to grind the seat of a valve in a flow line when the valve and the flow line are located within a ditch, trench or pit below the surface of the ground.

SUMMARY OF THE INVENTION

The foregoing and other objects and advantages of the invention are attained by flow valve seat grinding apparatus incorporating an improved steady rest. A tubular drive shaft housing houses and supports a rotatable and longitudinally movable drive shaft which is connected through a flexible torque coupler to drive a valve seat grinding head. The coupler is adapted to be locked from articulation for selected grinding operations. The grinding head is adapted to grind a valve seat located within a valve body. The shaft housing is laterally supported in movable relation within a lateral support journal. The support journal is connected to a support bracket to be adjustably fixed through clamps to the upper portion of a valve body. The valve body is formed with an elongated cavity having a cylindrical sidewall. A steady rest mechanism including an adjustable anchor is adjustably mounted on the shaft housing below the lateral support journal and near the torque coupler. The adjustable anchor is operable to laterally extend at least three anchor members into fixed anchoring contact with the inside wall of the valve body and thereby to laterally support the shaft housing in fixed position within the valve body.

The adjustable anchor includes a housing, a cam plate formed with at least three camming surfaces and rotatably mounted within the housing, and at least three camming heads extending into the housing from outside the housing and into camming contact with the camming surfaces. At least three anchor members are connected to the cam heads outside the housing. A pinion drive rotates the cam plate and thereby extends the anchor members outwardly from the housing as desired. A locking bolt is provided to fix the cam plate against rotation within the housing as desired. The pinion drive for rotating the cam plate includes an arcuate rack gear connected to the cam plate and a pinion gear connected to rotate the rack gear.

DESCRIPTION OF A PREFERRED EMBODIMENT

Figure 2:
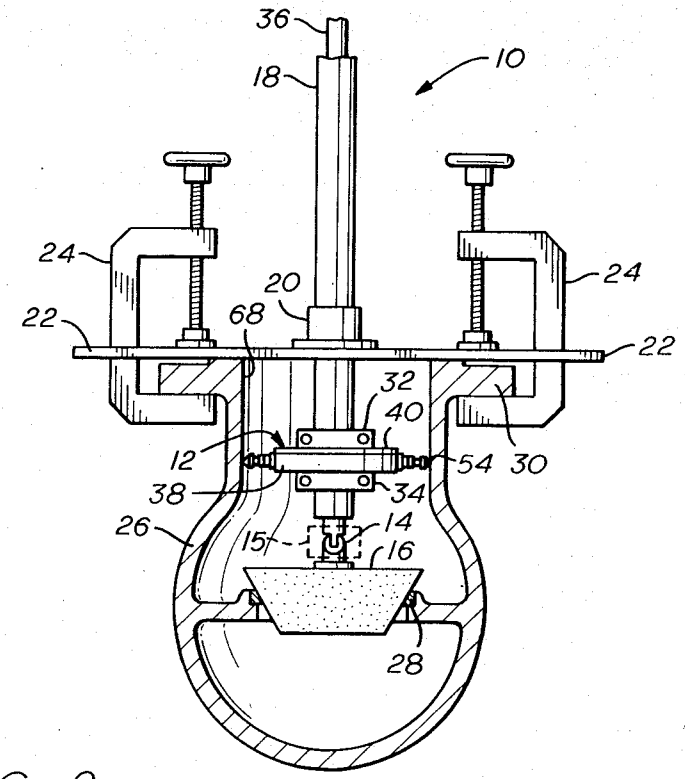
FIG. 2 is a partly sectional elevational view of the apparatus and the valve body as shown in FIG. 1.
Figure 1:
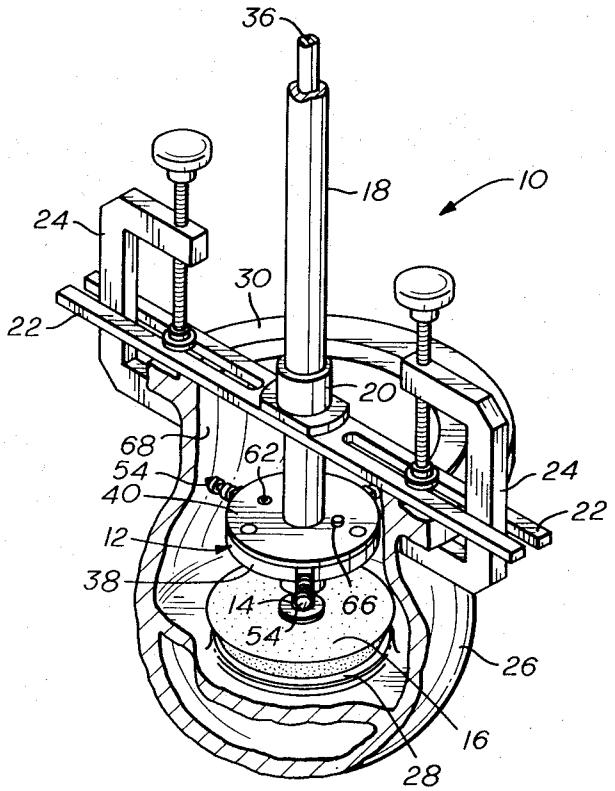
FIG. 1 is a partly sectional perspective view of the apparatus of the present invention as installed in grinding position within a valve body of the globe type.

As seen in FIGS. 1 and 2, there is shown the steady rest 10 portion of a valve grinding apparatus as connected for use to grind a valve seat 28 in situ within a valve body 26. The remainder of the valve grinding apparatus (not shown) is a conventional drive mechanism such as an air motor, hydraulic motor, or electric motor along with appropriate speed reduction gearing as needed.

An important component of steady rest 10 is an adjustable support anchoring apparatus 12 fitted about and receiving a drive shaft housing 18 and retained in appropriate position with an upper retainer collar 32 and a lower retainer collar 34 which are adjustably attached to the housing 18. A drive shaft 36 extends through the housing 18. Housing 18 and shaft 36 are connected into the above mentioned drive unit (not shown). Shaft 36 is mounted to be both rotatable and vertically movable within the housing 18.

At the lower end of housing 18, the shaft 36 is connected through a flexible torque coupler 14 to a grinding head 16 shown schematically to be in grinding contact with a valve seat 28. A suitable kind of coupler to be utilized as coupler 14 is disclosed in more detail in U.S. application Ser. No. 843,292, filed Mar. 24, 1986, as previously identified. Alternately, a modification of the coupler such as shown in U.S. Pat. No. 4,287,688 may be utilized.

It is to be noted that the coupler 14 optionally may be locked from articulation so as to operate as a straight shaft by a slidable locking collar 15 which may be slipped to an end to permit articulation of coupler 14. The coupler 14 is desirably locked when a tapered seat is being ground as shown in FIG. 2. The coupler 14 would be desirably unlocked and free to articulate if a flat seat (not shown) were being ground.

As shown, the shaft housing 18 is laterally supported by a lateral support journal 20 which in turn is connected to extension bracket bars 22 which extend outwardly across the top of a valve bonnet flange 30 of the valve 26. The bracket bars 22 are respectively connected to the flange 30 by means of conventional "C" clamps 24 as shown. As provided, the C clamps 24 adjustably fix the bracket bars 22 to the valve flange with the housing 18 substantially centered to place the grinding head 16 into appropriate position to grind the valve seat 28.

A steady rest housing 38 included in the anchoring apparatus 12 carries at least 3 extendable conical anchors 54 which are adjustably extended into anchoring contact with an inner wall 68 formed as a wall of the cavity defined within the valve body 26. The anchors 54 are extended by rotating a pinion shaft 62 and the anchors 54 are locked into anchoring position by an anchor or locking bolt 66 as later described with reference to FIGS. 3–5.

Figure 3:
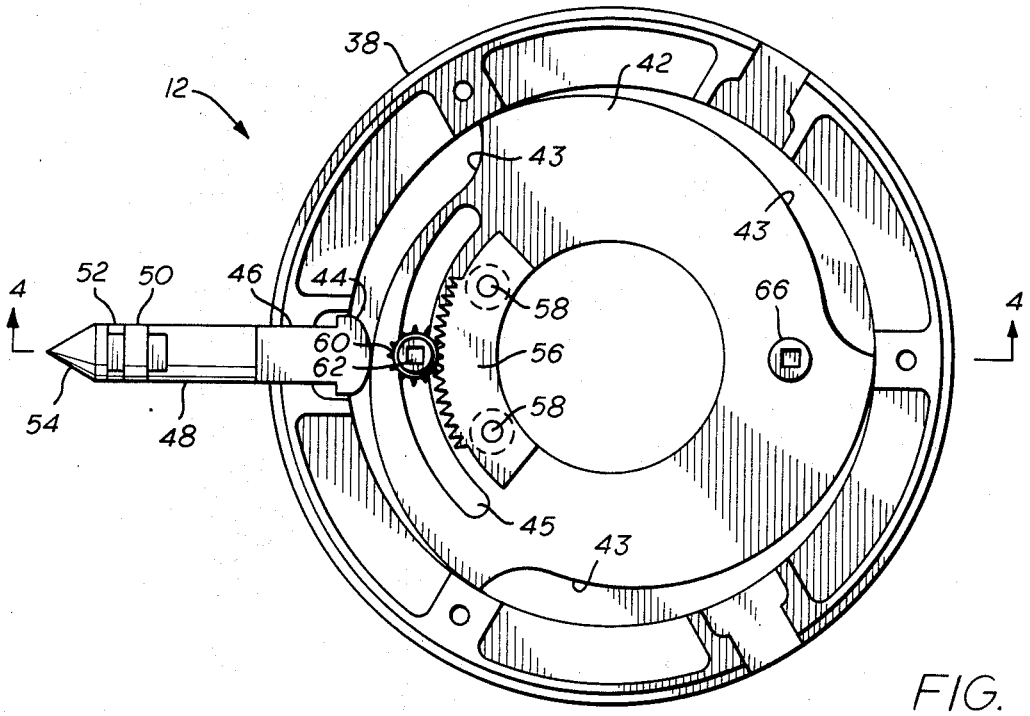
FIG. 3 is a transverse partly sectional view of the adjustable anchor apparatus shown within the valve body in FIGS. 1 and 2 and taken along the line 3—3 of FIG. 4.
Figure 4:
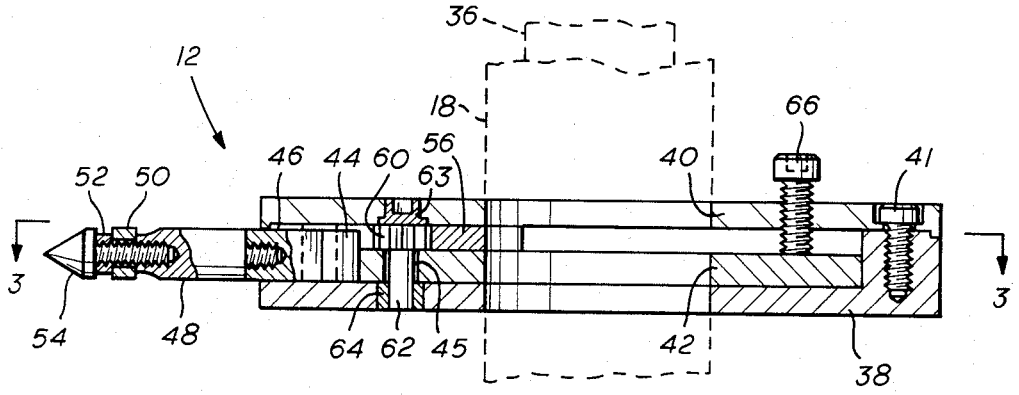
FIG. 4 is a partially sectional longitudinal view of the anchor mechanism of FIG. 3 as taken along the line 4—4 of FIG. 3.
Figure 5:
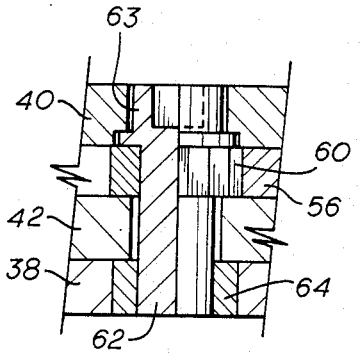
FIG. 5 is a detailed partially sectional view of the rack and pinion shown in FIG. 4.

Referring now to FIGS. 3–5, the adjustable support anchoring apparatus 12 includes a steady rest housing 38 which houses a cam plate 42 formed with at least three cam surfaces 43. An arcuate rack gear 56 is attached to the cam plate 42 by means of retainer pins 58 as shown in FIG. 3. The rack gear 56 and the cam plate 42 is rotated as desired by means of a pinion gear 60.

A rotatable pinion shaft 62 having an actuating head 63 is pressed fitted into the pinion gear 60 and a journal sleeve 64 and retained in engagement with the gears of rack gear 56 by means of a cover or retainer plate 40 as shown in FIGS. 4 and 5. As shown, rotation of the pinion gear 60 by the pinion shaft 62 and actuating head 63 serves to rotate the cam plate 42 through a prescribed sector.

Cam heads 44 are disposed at the ends of expansion blocks 46 and the blocks 46 are provided to extend in sliding relation through appropriate openings in the housing 38. The cam heads 44 are in camming contact with the cam faces 43 of the cam plate 42 whereby rotation of the cam plate 42 will cause the cam faces 43 to force the cam heads 44 outwardly and thereby extend the extension blocks 46 outwardly as well.

Each of the extension blocks 46 is connected to an extension arm 48 which in turn is connected to a conical anchor 54 through a spacer sleeve 50 and a lock nut 52.

As provided, different lengths of of the extension arm 48 provide a range of diameters to accommodate the internal wall 68 of valve 26 wherein the apparatus 10 may be used. The spacer sleeves 50 bring the anchor 54 out more closely to the internal wall. The adjustable threaded connection of anchor 54 into the extension arm 48 may bring the anchor 54 yet closer, if desired, to the internal walls of the valve 26 when the cam 42 is rotated to place the cam faces 43 and the heads 44 to a minimally extended position. The lock nut 52 locks the assembly of anchor 54, spacer sleeve 50 and extension arm 48 into an integral unit for a particular valve size. A locking bolt 66 is threadedly connected through the retainer plate 40 into adjustable contact with cam plate 42. At such time as the anchors 54 are in the desired anchoring position, then plate 42 is locked within housing 38 with locking bolt 66.

OPERATION OF THE PREFERRED EMBODIMENT

In operation, the assembly 10, which carries a power unit attached to housing 18 and shaft 36, is initially adjusted for insertion and use within a valve such as valve 26. The grinding head 16 is of appropriate size and shape for a valve seat 28. The extension arms 48 and spacer sleeves 50 are utilized to bring the adjustable support anchor 12 into anchoring relationship with the walls 68 of the valve 26. The support anchor 12 is adjusted by means of the retainer collars 32 and 34 to be an appropriate supporting distance above the grinding head 16 and also bring the anchoring support 12 up into a cylindrical portion of the internal wall 68.

The assembly 10 is then assembled with the support journal 20 and extension bars 22 as shown in FIG. 1 and lowered into appropriate position within the valve as shown in FIGS. 1 and 2. The shaft housing 18 is initially centered within the valve flange 30 and the clamps 24 are utilized to clamp the bracket bars 22 to the flange 30 as shown in FIGS. 1 and 2.

The pinion shaft 62 is then rotated by means of an extended driver wrench (not shown) to rotate the cam plate 42 whereby the cam surfaces 43 force the cam heads 44 and the anchors 54 into firm anchoring contact with the walls 68. The anchors 54 are formed conically to a rather sharp point, as shown in FIGS. 3 and 4, and these points may be slightly pressed into the metallic wall 68 for firm anchoring.

The shaft 36 may then be extended downwardly through the housing 18 to bring the grinding 16 into forceful grinding contact with the valve seat 28. The universal coupler 14 is locked out, causing the grinding head 16 to be guided into the valve seat 28, so that the valve seat 28 is ground to its smooth original shape.

It is to be noted that the grinding assembly 10 as shown in FIGS. 1 and 2 may be modified, principally through modification of the housing 18 so that the grinding head 16 can be extended at right angles to the housing 18 and adapted to grind the seats of a gate valve (not shown). Thus, for example, the apparatus 10 as herein disclosed may be adapted to be incorporated in a valve grinding mechanism such as disclosed in U.S. Pat. No. 4,278,688.

It is to be understood that this single embodiment as herein disclosed can be modified and changed considerably and yet remain within the spirit of the invention and the scope and purview of the appended claims.

What is claimed is:

1. In flow valve seat grinding apparatus incorporating improved steady rest means, the combination comprising:

(a) a tubular drive shaft housing means which houses and supports a rotatable and longitudinally movable drive shaft means, said shaft means being connected through a flexible torque coupler means to drive a valve seat grinding head means, said grinding head means being adapted to grind a valve seat located within a valve body;

(b) said valve body being formed with an elongated cavity having a sidewall;

(c) said shaft housing means being laterally supported in movable relation within a lateral support journal means;

(d) said support journal means being connected to support bracket means to be adjustably fixed through clamping means to the upper portion of said valve body;

(e) steady rest means including adjustable anchor means adjustably mounted within said cavity around said shaft housing means below said lateral support journal means and near said torque coupler means; and (f) said adjustable anchor means being operable to laterally extend at least three anchor members into fixed anchoring contact with said sidewall of said valve body and thereby to receive and to laterally support said shaft housing means in fixed position within said valve body.

2. The combination of claim 1 wherein said adjustable anchor means comprises:

(a) an anchor housing means;

(b) a cam plate means formed with at least three camming surfaces and rotatably mounted within said anchor housing;

(c) at least three camming head members extending into said anchor housing from outside said anchor housing with camming heads in camming contact with said camming surfaces;

(d) at least three anchor members connected to said cam head means outside said anchor housing;

(e) means for rotating said cam plate means and thereby extend said anchor members outwardly from said anchor housing; and (f) locking means to fix said cam plate means against rotation within said anchor housing.

3. The combination of claim 2 wherein said means for rotating said cam plate means includes an arcuate rack gear connected to said cam plate means and a pinion gear rotatably connected to rotate said rack gear.

4. The combination of claim 2 wherein said locking means is a threaded bolt movable into locking contact against said cam plate means.

5. The combination of claim 1 further including coupler locking means to lock said flexible torque coupler means from articulation.

6. The combination of claim 1 wherein said grinding head means is operative to grind said valve seat to its original shape.

7. In flow valve seat grinding apparatus incorporating improved steady rest means, the combination including adjustable anchor means operable to laterally extend at least three anchor members into fixed anchoring contact with a sidewall of a valve body and thereby to receive and to laterally support a shaft housing means in fixed position within said valve body, said adjustable anchor means comprising:

(a) an anchor housing;

(b) a cam plate means formed with at least three camming surfaces and rotatably mounted within said anchor housing;

(c) at least three camming head members extending into said anchor housing from outside said anchor housing with camming heads in camming contact with said camming surfaces;

(d) said anchor members being connected to said cam head means outside said anchor housing;

(e) means for rotating said cam plate means and thereby extend said anchor members outwardly from said anchor housing; and (f) locking means to fix said cam plate means against rotation within said anchor housing.

8. The combination of claim 7 wherein said means for rotating said cam plate means includes an arcuate rack gear connected to said cam plate means and a pinion gear rotatably connected to rotate said rack gear.

9. The combination of claim 8 wherein said locking means is a threaded bolt movable into locking contact against said cam plate means.

10. The combination of claim 8 wherein valve body is a globe valve body.

11. The combination of claim 8 wherein said grinding head means is operative to grind said valve seat to its original shape.

12. An adjustable anchor means operable to laterally extend at least three anchor members into fixed anchoring contact with a sidewall of a valve body and thereby to receive and to laterally support a shaft housing means in fixed position within said valve body, comprising:

(a) an anchor housing;

(b) a cam plate means formed with at least three camming surfaces and rotatably mounted within said anchor housing;

(c) at least three camming head members extending into said anchor housing from outside said anchor housing with camming heads in camming contact with said camming surfaces;

(d) at least three anchor members connected to said cam head means outside said anchor housing;

(e) means for rotating said cam plate means and thereby extend said anchor members outwardly from said anchor housing;

(f) said means for rotating said cam plate means including an arcuate rack gear connected to said cam plate means and a pinion gear rotatably connected to rotate said rack gear; and (g) locking means to fix said cam plate means against rotation within said anchor housing means.

13. The combination of claim 12 wherein said locking means is a threaded bolt movable into locking contact against said cam plate means.

14. The combination of claim 12 wherein valve body is a globe valve body.

15. The combination of claim 12 wherein said grinding head means is operative to grind said valve seat to its original shape.

* * * * *